US006913332B1

(12) United States Patent
Besterfield et al.

(10) Patent No.: US 6,913,332 B1
(45) Date of Patent: Jul. 5, 2005

(54) COLLAPSIBLE COMPUTER WORKSTATION

(75) Inventors: Glen H. Besterfield, Tampa, FL (US); Chris Ollman, Tampa, FL (US); Steve Gabrielse, Tampa, FL (US); Kathy Esser, Tampa, FL (US); Kevin Riordan, Clearwater, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 10/707,766

(22) Filed: Jan. 9, 2004

Related U.S. Application Data

(60) Provisional application No. 60/319,847, filed on Jan. 9, 2003.

(51) Int. Cl.[7] ..... H05K 7/18

(52) U.S. Cl. ..... 312/223.3; 361/796; 248/917; 108/50.01

(58) Field of Search ..... 312/223.1–223.6, 312/198, 194; 248/286.1, 917–923; 108/50.01; 439/131

(56) References Cited

U.S. PATENT DOCUMENTS

| | | | | |
|---|---|---|---|---|
| 4,669,789 A | | 6/1987 | Pemberton | 312/223.3 |
| 4,735,466 A | | 4/1988 | Wolters et al. | 312/24 |
| 4,735,467 A | | 4/1988 | Wolters | 312/29 |
| 4,766,422 A | | 8/1988 | Wolters et al. | 312/198 |
| 4,828,342 A | | 5/1989 | Stefan | 312/223.3 |
| 5,199,773 A | | 4/1993 | Price, Jr. et al. | 312/7.2 |
| 5,553,820 A | | 9/1996 | Karten et al. | 248/286.1 |
| 5,611,608 A | | 3/1997 | Clausen | 312/223.3 |
| 5,651,594 A | * | 7/1997 | Lechman | 312/194 |
| 5,729,430 A | | 3/1998 | Johnson | 361/682 |
| 6,016,755 A | | 1/2000 | Trapani | 108/50.01 |
| 6,059,385 A | | 5/2000 | Guhl | 312/223.2 |
| 6,095,385 A | * | 8/2000 | Utu et al. | 224/153 |
| 6,626,686 B1 | * | 9/2003 | D'Souza et al. | 439/131 |

FOREIGN PATENT DOCUMENTS

| | | |
|---|---|---|
| JP | 01218633 A | 8/1989 |
| JP | 01218634 A | 8/1989 |
| JP | 02191447 A | 7/1990 |
| JP | 10174623 | 6/1998 |

* cited by examiner

*Primary Examiner*—Hung Van Duong
(74) *Attorney, Agent, or Firm*—Smith & Hopen, P.A.

(57) ABSTRACT

A retracting keyboard and monitor platform is provided. By using a lift mechanism a monitor is lifted, vertically, from the back of the desk. When a user is done the screen retracts and disappears. Installation of the device requires that an opening be cut in the back of the desk. One advantage to this concept is the increased work surface. Also, when a flat panel monitor is used a minimum of leg space is lost on the underside of the desk.

9 Claims, 6 Drawing Sheets

COLLAPSIBLE COMPUTER WORKSTATION

CROSS-REFERENCE TO RELATED DISCLOSURES

This application claims priority of a provisional application of the same title, filed Jan. 9, 2003 by the present inventors and bearing application No. 60/319,847.

BACKGROUND OF INVENTION

1. Field of Invention

This invention relates to a retractable computer workstation.

2. Background of Invention

The standard work environment poses substantial obstacles to those with a limited range of motion. Drawers, for example, or other items placed below the level of the desktop are largely inaccessible. This creates a situation in which the centralized desktop area becomes invaluable and must accommodate most of the items that must be utilized on the job.

For purposes of workspace, a person is considered, generally, to have a limited range of motion if they have a maximum reach of 18 inches (usually measured from the center command position). For those afflicted, every inch of workspace is valuable and anything that maximizes accessibility translates into decreased frustration and increased productivity.

An assessment of the tasks and duties that are normally considered to be a part of the office environment was performed, taking into consideration the restrictions imposed by a limited range of motion. The tasks that are most commonly encountered include filing, writing, answering the telephone, book research, and filling out forms. Of the tasks considered, many, if not most, have been primarily computerized. Paper filing systems, for instance, are becoming obsolete because computers are a much faster and more efficient means of keeping records.

An efficient workstation must be able to accommodate a computer. Computers, however, have a way of monopolizing desk space and cannot be easily moved to make space for other activities. An ideal work station would incorporate a computer that can be easily removed from the desktop to make way for other things.

The prior art reveals other attempts to free workspace use by peripheral computer components such as monitors. U.S. Pat. No. 5,553,820 to Karten et al. describes a monitor support arm. The support arm allows a user to swing a monitor from a central, usable, position to an out-of-the-way position. Although this system does free workspace, a user with a limited range of motion might not be able to manipulate the arm. Also, the swing arm does nothing to remove input devices, such as the keyboard and mouse, from the desktop.

U.S. Pat. No. 5,729,430 to Johnson describes a corner mounting unit adapted to support a computer monitor. Although this system clears the central work area, the '430 patent does not provide for completely removing the monitor and input devices completely from the work surface. Moreover, the twisting motion required to view a corner-mounted monitor could exacerbate problems associated with limited range of motion.

SUMMARY OF INVENTION

Provided is a computer workstation comprising a substantially flat work surface, wherein the work station is substantially flush with the work surface when the work station is in the retracted position, an opening in the substantially flat work surface, a base hingeably coupled to the work surface having a first side and a second side, the base having a retracted position and a deployed position, each position representative of the range of hinged movement of the base, a monitor mount having a lower portion affixed coincident to the hinged coupling of the plate whereby the monitor mount is received within the opening in the work surface when the base is in a retracted position and the monitor is oriented perpendicular to the work surface when the base is in a deployed position, at least one or more computing input devices removeably affixed to the first side of the base whereby, when the base is in a retracted position, the at least one or more computing input devices are inverted relative to their useable orientation, the work station being received within the opening in the work surface and disposed thereunder, and a mechanism for delivering the base between the retracted and deployed position.

For those facing physical limitations an electric motor moves the assembly from the retracted to deployed position. To maximize leg space under the work surface, as well as requiring a lower powered motor, the monitor mount can be adapted to receive a flat panel monitor. The device can be deployed using a hand driven mechanism (such as a crank) or a handle.

By using a lift mechanism a monitor is lifted, vertically, from the back of the desk. When the user is done using the computer the screen and input devices retract and disappear. Installation of the device requires an opening to be cut in the back of the desk. One advantage to this concept is the increased work surface. Also, when a flat panel monitor is used a minimum of leg space is lost on the underside of the desk.

The present invention comprises a retracting mechanism which houses a monitor, mouse, and keyboard that disappear into the desk when not needed. The apparatus retracts and deploys with just the push of a button. The invention has applications for people with disabilities as well as anyone who has a computer at their desk. The retracting mechanism is designed to be unobtrusive, user friendly, and easy to install. The collapsed workstation remains flush with the work surface of the desk. In one embodiment the work station mounts seventeen inches from the front of the desk and has a depth of only six inches, allowing plenty of clearance for long legs or wheelchair arms. When the workstation is fully deployed the keyboard and mouse are positioned towards the front of the desktop with the monitor positioned approximately in the middle of the desk. To maximize leg space the work station may incorporate a flat panel monitor as well as a wireless keyboard and mouse. The wireless keyboard can be easily disengaged from its mount to be placed in a more comfortable position.

In an embodiment of the invention, the retracting mechanism is lockable in either a retracted or deployed position. The lock may be manually actuated such as in a key-tumbler configuration or by a combination lock. Alternatively, the lock may be electronically actuated such as by a solenoid device. An electronic keypad may be communicatively coupled to the electronically actuated lock to enable the mechanism to deploy and retract. A biometric reader may be communicatively coupled to the electronically actuated lock whereby biometric data including, but not limited to fingerprints, handprints, retina scans, and voice prints may verify the identity of the person seeking to unlock the mechanism. In an embodiment of the invention, the biometric reader may be coupled to the computer itself whereby the security software used to authenticate the identity of the person seeking to deploy the mechanism resides thereon. Alternatively, the biometric reader or the electronic keypad may be communicatively coupled to a remote network whereby authentication is handled apart from the computer sought to be deployed.

In yet another embodiment of the invention, the deployed computer is communicatively coupled to a motor controlling deployment and retraction of the mechanism. Responsive to a predetermined period of inactivity, a software process resident on the deployed computer transmits an I/O communication to the motor to retract the computer and optionally power down the computer. An advantage of this feature is that in high-security environments, the computer is not just locked by software security, but physically locked down after a period of non-use. The period of non-use is typically measured from a lack of keyboard or mouse activity generated by the end user of the computer.

In yet another embodiment of the invention, an obstruction in the retraction of the mechanism is detected by a motor load current value, motor speed or other such obstruction detecting methods as known to those skilled in the art. An advantage of including an obstruction detection means is to prevent injury or failed retraction for security concerns. It is preferred that the obstruction detection means is communicatively coupled to an alarm to signal that an obstruction is present.

In yet another embodiment of the invention, a gasket seals the base to the opening in the work surface. Preferably, an elastomeric gasket is combined with the retraction mechanism to generate enough force to create an substantially fluid-tight seal. The advantages to this embodiment include the ability to deploy a computer in locations that enduring varying weather conditions such as on a research vessel at sea or on a portable terrestrial unit. If a diagnostic computer was needed to fix equipment in harsh conditions such as in snow or in a dessert, then a sealable retraction mechanism would search to keep moisture and particles away from the computer when the computer was not in use. An advantage of this embodiment is that the mechanism can be reused even if the computer, monitor or keyboard is replaced. Thus, expensive and proprietary environmentally resistant computer equipment is not required. Another application of a fluid-tight enclosure is that of laboratories and clean rooms. If a workbench needs to be disinfected or sterilized, the computer may be retracted into the workbench itself. During laboratory operations that are sensitive to contamination, the computer may be retracted. Inherently, a flat work surface is easier to clean than the uneven surface of a computer keyboard, mouse, monitor and CPU.

In yet another embodiment, the monitor mount can be adapted to accommodate more than one monitor. As the processing power of computers increase, the ability to utilize more than one or more monitors is becoming more common. This is particularly true where high powered computers are used for graphic design and modeling. The advantage of this embodiment is the apparatus can be utilized not only in a standard office environment, but in highly specialized and technically advanced work areas.

In yet another embodiment, the apparatus would retract when signaled remotely. The remote lockdown procedure could be initiated from a variety of input sources. As computers become more prevalent in the classroom, for example, an instructor would have the ability to lockdown the student's monitors for exam preparation. This provides an added benefit in situations where computers are appropriate for some courses but not others. The advantage of this embodiment is that certain classrooms no longer have to be designated for computer purposes only. Alternatively, the lockdown signal could originate from a wireless source, similar to the technology used in keyless entry devices found in the auto industry.

In yet another embodiment, an adaptable "shield" deploys with the workstation. The shield prevents articles on the work surface from falling into the outer box assembly when the work station is deployed. The shield provides the obvious advantage of preventing damage to the computer peripherals caused by contact with items that have fallen into the outer box. The shield could take many forms, including a louver system. Such a louver system would allow the shield to be deployed in the same plane as the work surface. Such a system would not occupy more space since when retracted the louvers would fold down along the bottom of the outer box, in a fashion similar to that used in a roll-top desk. The shield may be dynamically connected to the outer box and travel through grooves in the sides and back of the outer box. The shield may be deployed automatically, along with the activation of the apparatus, or manually.

In yet another embodiment, the apparatus is communicatively connected to a building's fire alarm and/or sprinkler system. In this embodiment, the system retracts when either the fire alarm or sprinkler system is activated. When the outer box is constructed of heat or fire resistant materials, this embodiment provides protection of hardware in emergency situations. This embodiment can effectively be coupled with an elastomeric gasket (discussed supra) to prevent water from the sprinkler system from pervading the outer box assembly. The system could easily be adapted to an intruder alarm system in high-security situations, such as military applications.

In yet another embodiment, the base and monitor mount can be adapted to accommodate a laptop, tablet pc, or any portable computing device. As the use of portable computing devices increases, this embodiment allows security of such devices when the user leaves the workstation.

DETAILED DESCRIPTION

When the mechanism is installed, the computer, mouse, and keyboard retract and then fold out again when needed. An embodiment of the invention comprises a drive mechanism, such as small dc or ac motor, or a hand driven mechanism that rotates the monitor, mouse and keyboard toward the user from the desktop. All that is required to install the invention is to cut a standard hole into an existing desktop and place this station into it the cutout section. The top of the station remains flush with the top of the desktop or work surface. In so doing virtually no legroom would be taken up by this mechanism, when using a flat panel monitor. The invention is equally effective in any office work station where ones computer monopolizes a majority of the available workspace.

The invention further comprises two pairs of bar linkages. The primary linkage pair transfers the power from the drive mechanism to the monitor mounting assembly. The secondary linkage pair governs the relative motion of the keyboard mounting plate to the monitor mount. It is desireable to negate the possible effects of magnetic interference with the electronics enclosed in the case that houses the mechanism. Fourteen-gauge aluminum provides one solution to this problem. In one embodiment aluminum is used to form the outer box, and the remaining frame pieces are machined from half inch aluminum plate or bar stock. Alternatively, the outer box could be stamped from a sheet, then pressed to shape and tack welded in the corners. The bracket that mounts the motors and linkages to base and monitor mount can be integrated into the outer box, thus requiring, less machining in the construction process.

One embodiment utilizes a pair of MOLON τ reversible DC motors rated at 50 in/lbs. However, the use of two motors is not required if a single reversible motor is available with sufficient torque. DC motors have the advantage that they are not a shock hazard if the motors for some reason ground out against the case. A hand driven mechanism, such as a cranking apparatus or handle also negates the possibility of a shock hazard.

Figure 1:
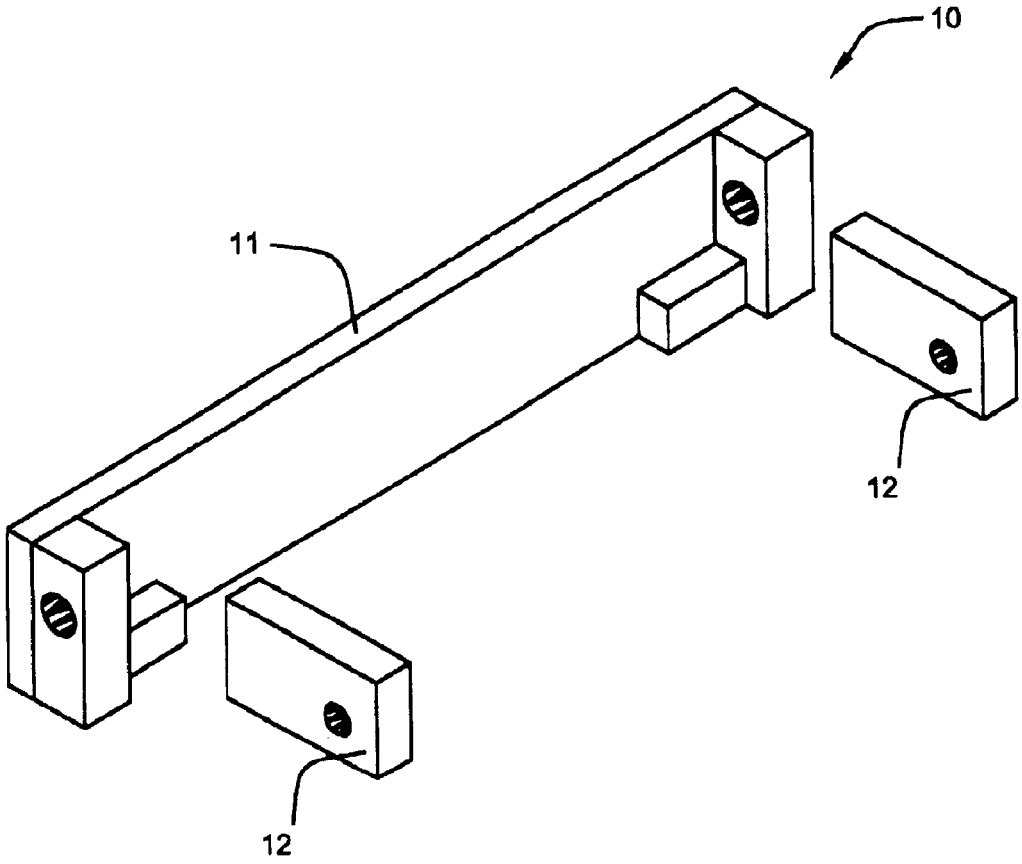
FIG. 1 is an isometric, partially exploded view of the mechanism frame sub-assembly.

Turning now to the figures, FIG. 1 shows the mechanism frame sub-assembly 10. As shown the mechanism frame sub-assembly 10 comprises a frame assembly mounting bracket 11 and a pair of motor-assembly mounts 12, large and small bearings, and socket head cap screws (not shown). The frame sub-assembly 10 is connected to the inside of the assembly box (FIG. 6, 65) as well as the primary and secondary links (as shown in FIG. 3 infra).

Figure 2:
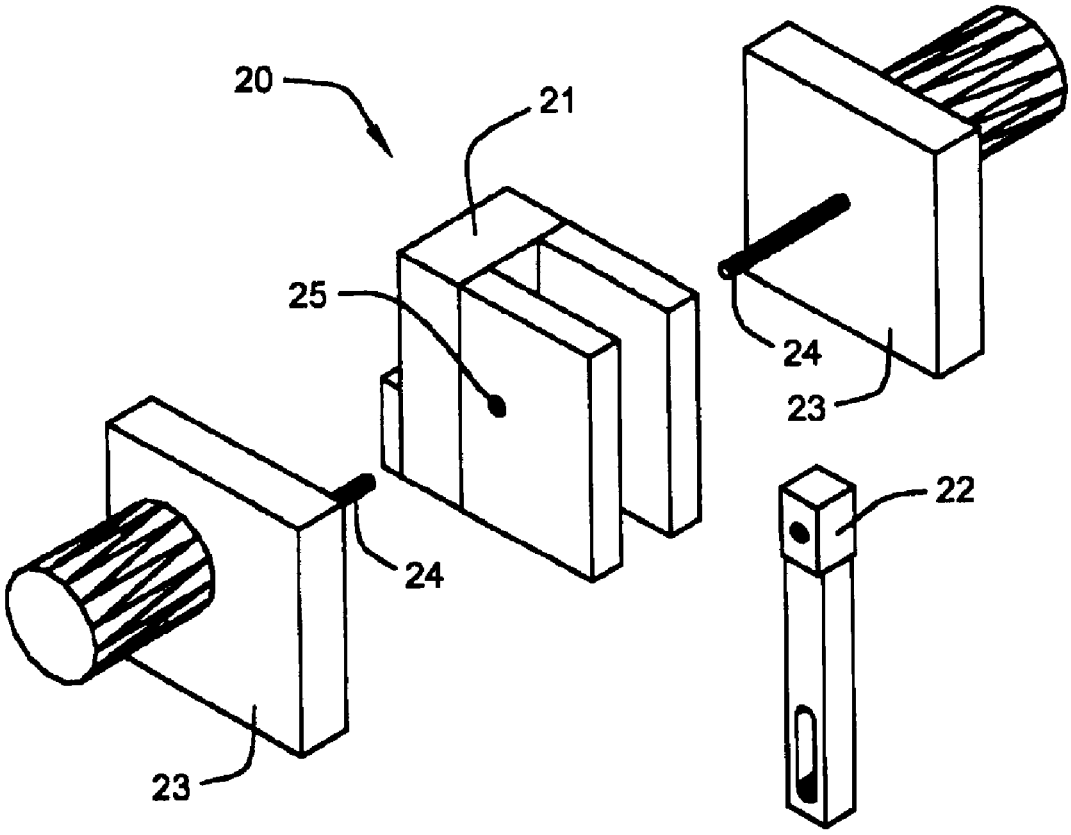
FIG. 2 is an isometric, partially exploded view of the motor sub-assembly and its constituent parts.

FIG. 2 provides an exploded view of the motor sub-assembly20. The sub-assembly 20 comprises a motor mount 21, motor drive link 22, and motor(s) 23. The motor pin 24 is inserted in a corresponding opening 25 in the motor mount 21. The motor pin 24 passes through the opening 25 in the motor mount 21 and engages the motor drive link 22. Where two motors are used, as shown here, a flat spot on each pin 24 must be identified and meshed with the corresponding pin. Power is applied to either motor23 with a 9-V battery.

Figure 3:
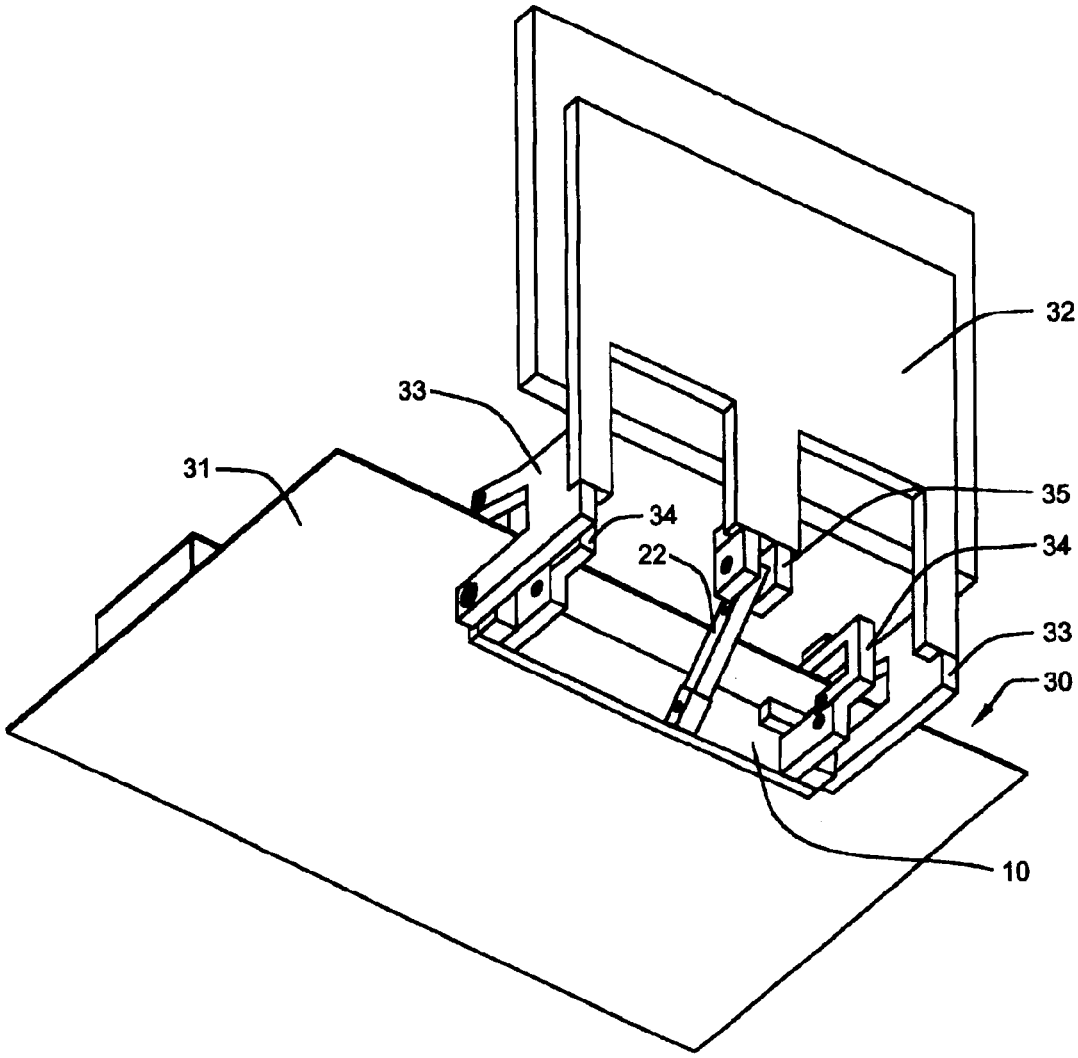
FIG. 3 is an isometric, elevated bottom view of the work station assembly coupled with the mechanism frame sub-assembly (motor sub assembly not shown)

FIG. 3 is a bottom view of the work station assembly 30. From this angle it can be seen how the frame sub-assembly 10, without the motor assembly, interacts with the base 31 and monitor mount 32. The frame sub-assembly 10 is connected to the interior of the assembly box (FIG. 6, 65) nearest the user. The monitor mount 32 is connected to the primary links 33 which are in turn connected to the base 31 on the keyboard bearing surface. The secondary 34 and primary links 33 connect the base 31 to the frame sub-assembly 10. The motor drive link 22, hingically connects to the pivot pin mount 35, as shown (here not attached to the motor assembly).

Figure 4:
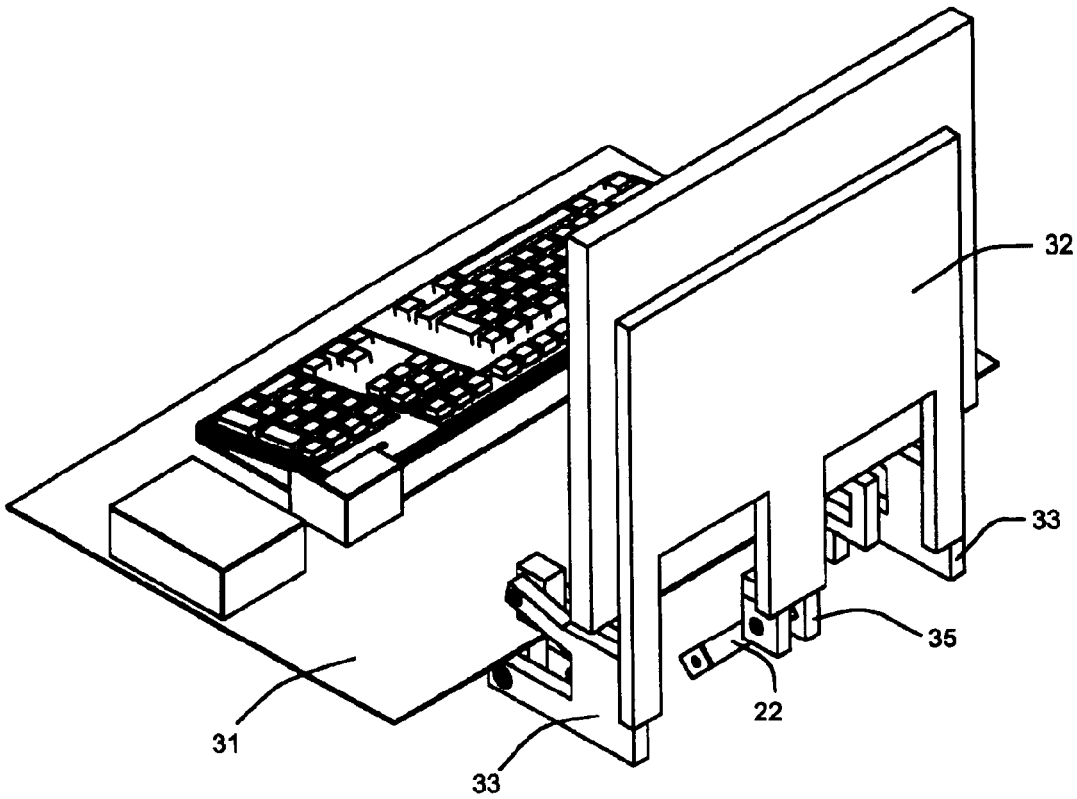
FIG. 4 is an isometric, rear elevated view of the work station assembly (motor sub assembly not shown).
Figure 5:
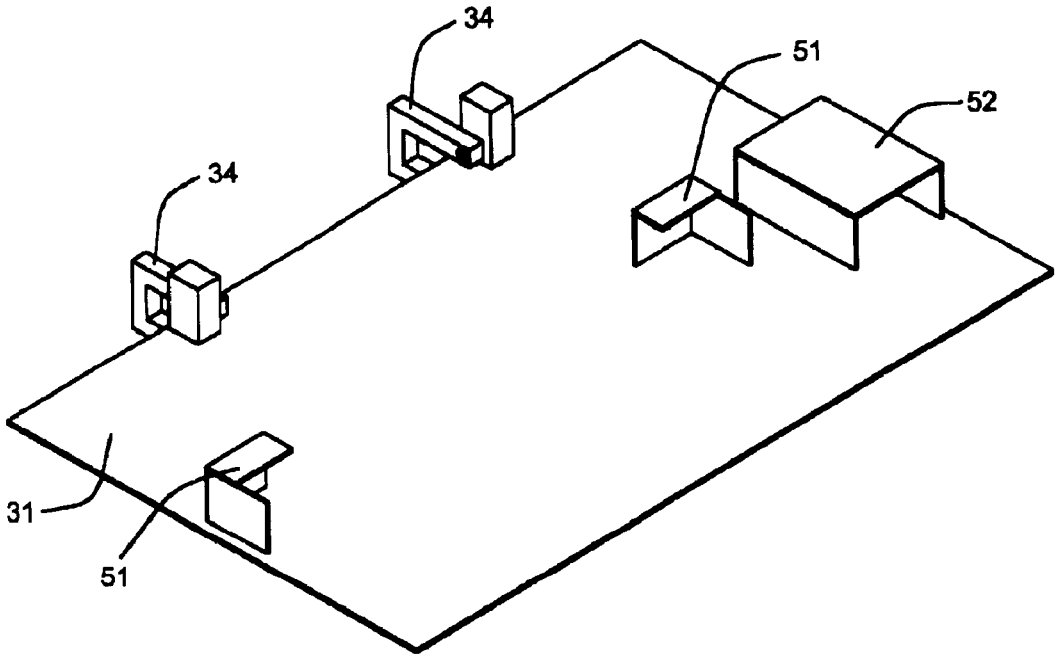
FIG. 5 is an isometric view of the base assembly without the monitor mount attached. Shown are the secondary links and input-device brackets.

FIG. 4 shows the invention as seen from the rear when the work station is deployed. From this view it can be seen how the primary linkage 33 is dynamically connected to the base 31 and statically connected to the monitor mount 32. The force applied through the motor drive link 22 is applied to the monitor mount 32, through the pivot pin mount 35, and moves the entire assembly. Likewise, FIG. 5 shows how the secondary links 34 are dynamically connected to the base 31. Also shown are the receptacles for the keyboard 51 and mouse 52.

Figure 6:
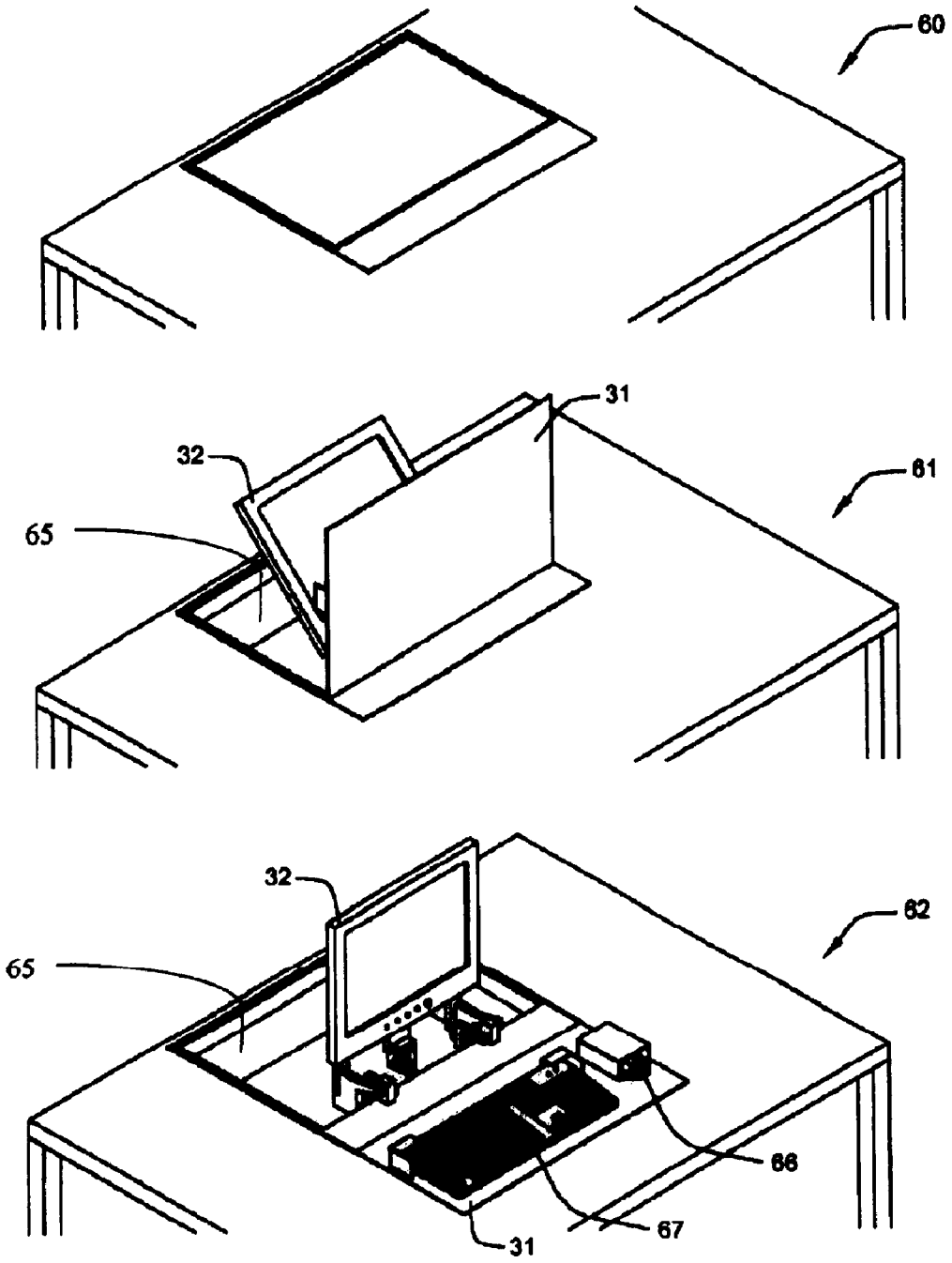
FIG. 6 is an isometric sequence view of the device in motion, showing the invention in the retracted, midway, and deployed positions.

Finally, FIG. 6 shows the invention in application as it travels from its retracted position 60. Midway through deployment/retraction 61 the monitor mount 32 is at a 45 degree angle and the base 31 is at a 90 degree angle, respective to the work surface. When fully deployed 62 the monitor mount 32 is at a 90 degree angle and the base 31 rests in its usable position. Also shown is the outer box 65 which holds the workstation apparatus. The input devices, here a mouse 66 and keyboard 67, can then be removed from the base and used.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A computer workstation comprising:

a substantially flat work surface;

an opening in the substantially flat work surface;

a base hingeably coupled to the work surface having a first side and a second side, the base having a retracted position and a deployed position, each position representative of the range of hinged movement of the base;

a monitor mount having a lower portion affixed coincident to the hinged coupling of the plate whereby the monitor mount is received within the opening in the work surface when the base is in a retracted position and the monitor is oriented perpendicular to the work surface when the base is in a deployed position;

at least one or more computing input devices removeably affixed to the first side of the base whereby, when the base is in a retracted position, the at least one or more computing input devices are inverted relative to their useable orientation, received within the opening in the work surface and disposed thereunder;

a mechanism for delivering the base between the retracted and deployed position.

2. The workstation of claim 1 wherein the mechanism for delivering the base between the retracted and deployed position is an electric motor.

3. The workstation of claim 1 wherein the mechanism for delivering the base between the retracted and deployed position is a manually operated mechanism.

4. The workstation of claim 1 wherein the mechanism for delivering the base between the retracted and deployed position is a handle.

5. The work station of claim 1 wherein the work station is substantially flush with the work surface when the work station is in the retracted position.

6. The workstation of claim 1 wherein the work station is housed within an outer box.

7. The monitor mount of claim 1 wherein the monitor mount is adapted to receive a flat panel monitor.

8. The outer box of claim 6 wherein the outer box is received by the opening cut in the work surface.

9. A computer workstation comprising a substantially flat work surface, wherein the work station is substantially flush with the work surface when the work station is in the retracted position, an opening in the substantially flat work surface, a base hingeably coupled to the work surface having a first side and a second side, the base having a retracted position and a deployed position, each position representative of the range of hinged movement of the base, a monitor mount having a lower portion affixed coincident to the hinged coupling of the plate whereby the monitor mount is received within the opening in the work surface when the base is in a retracted position and the monitor is oriented perpendicular to the work surface when the base is in a deployed position, wherein the monitor mount is adapted to receive a flat panel monitor, at least one or more computing input devices removeably affixed to the first side of the base whereby, when the base is in a retracted position, the at least one or more computing input devices are inverted relative to their useable orientation, received within the opening in the work surface and disposed thereunder, and a mechanism for delivering the base between the retracted and deployed position, wherein the mechanism for delivering the base between the retracted and deployed position is chosen from the group consisting of an electric motor, a manually operated mechanism, and a handle.

* * * * *